US005288018A

United States Patent [19]

Chikazumi

[11] Patent Number: 5,288,018

[45] Date of Patent: Feb. 22, 1994

[54] WALL FOUNTAIN APPARATUS

[75] Inventor: Shinichi Chikazumi, Tokyo, Japan

[73] Assignee: Shu-koh-sha Architectural & Urban Design Studio, Tokyo, Japan

[21] Appl. No.: 962,102

[22] Filed: Oct. 16, 1992

[30] Foreign Application Priority Data

Oct. 16, 1991 [JP] Japan ..... 3-092153[U]

[51] Int. Cl.[5] ..... B05B 17/08

[52] U.S. Cl. ..... 239/20; 239/18; 239/17

[58] Field of Search ..... 239/17, 18, 20, 16, 239/19, 21, 22, 23, 500; 40/406, 441; 446/166; D23/201

[56] References Cited

U.S. PATENT DOCUMENTS

| | | | |
|---|---|---|---|
| 1,458,208 | 6/1923 | Houghton | 40/406 |
| 1,780,687 | 11/1930 | Smith | 239/23 |
| 3,409,223 | 11/1968 | Gosh | 239/23 |
| 3,901,439 | 8/1975 | Willis | 239/20 X |
| 3,921,902 | 11/1975 | Erikson et al. | 239/204 X |
| 4,160,427 | 7/1979 | Holbrook | 40/406 X |
| 4,202,056 | 5/1980 | Watkins | 239/17 X |
| 4,747,538 | 5/1988 | Dunn et al. | 239/20 |
| 5,005,762 | 4/1991 | Cacoub | 239/20 |
| 5,167,368 | 12/1992 | Nash | D23/201 X |

FOREIGN PATENT DOCUMENTS

| | | | |
|---|---|---|---|
| 260375 | 10/1912 | Fed. Rep. of Germany | 239/18 |
| 369610 | 4/1973 | U.S.S.R. | 40/406 |
| 2185541 | 7/1987 | United Kingdom | 239/17 |

*Primary Examiner*—Andres Kashnikow
*Assistant Examiner*—Lesley D. Morris
*Attorney, Agent, or Firm*—Cushman, Darby & Cushman

[57] ABSTRACT

A modular wall fountain apparatus has transparent sheets disposed in zigzags and supported by guide wires. A water supply is provided with nozzles directed toward the sheets which cause water currents to flow in zigzag paths. The zigzag water currents form a water screen which may be illuminated by color-changeable light projected from a lighting module. Each wall fountain module is made up of a transparent sheet module, water supply modules, lighting modules, and a control for the water supply and lighting. Various patterns of light can be created by controlling the color-changeable lighting and the flow of water. Because the water flows in zigzag paths the water makes softer sound than conventional wall fountain and is particularly suited for installation indoors.

14 Claims, 3 Drawing Sheets

WALL FOUNTAIN APPARATUS

BACKGROUND OF THE INVENTION

The present invention relates to a wall fountain apparatus.

Various kinds of wall fountain apparatuses have been set in various outdoor places such as parks, shopping centers, etc.

These conventional wall fountain apparatuses provide water currents which flow down only in specific directions along vertical walls, inclined walls or stepped walls. Thus, the flow velocities of the water currents generated by the conventional wall fountain apparatuses are rather high, so that the sound of the water currents is rather loud. Therefore, these conventional wall fountain apparatuses are typically not suited to be installed indoors.

SUMMARY OF THE INVENTION

An object of the present invention is to provide a wall fountain apparatus which generates water currents with soft sound, and which is suited to be installed indoors.

Another object of the present invention is to provide a wall fountain apparatus which generates water currents with soft sound, which is suited to be installed indoors, and the water currents of which form a water screen on which light patterns can be projected.

According to the present invention, there is provided a wall fountain apparatus comprising transparent guiding means for guiding water currents downward in zigzag paths and water supply means for supplying the transparent guiding means with water.

According to a preferred embodiment of the present invention, the transparent guiding means comprises transparent sheets or plates disposed in zigzags in the vertical direction and supporting means for supporting the transparent sheets, wherein the water supply means comprises a plurality of nozzles directed to the transparent sheets.

According to another aspect of the present invention, there is provided a wall fountain apparatus comprising a plurality of wall fountain modules disposed adjacent to one another in the vertical direction and in the transverse direction and controlling means for controlling the wall fountain modules. Each of the wall fountain modules has transparent guiding means for guiding water currents downward in zigzag paths, water supply means for supplying the transparent guiding means with water and lighting means for illuminating a water screen formed by the water currents. The controlling means is capable of controlling the water supply means and the lighting means individually.

Further objects, features and advantages of the present invention will become apparent from the Detailed Description of the Preferred Embodiments which follows, when read in conjunction with the accompanying drawings.

DETAILED DESCRIPTION OF THE PREFERRED EMBODIMENTS

Figure 1:
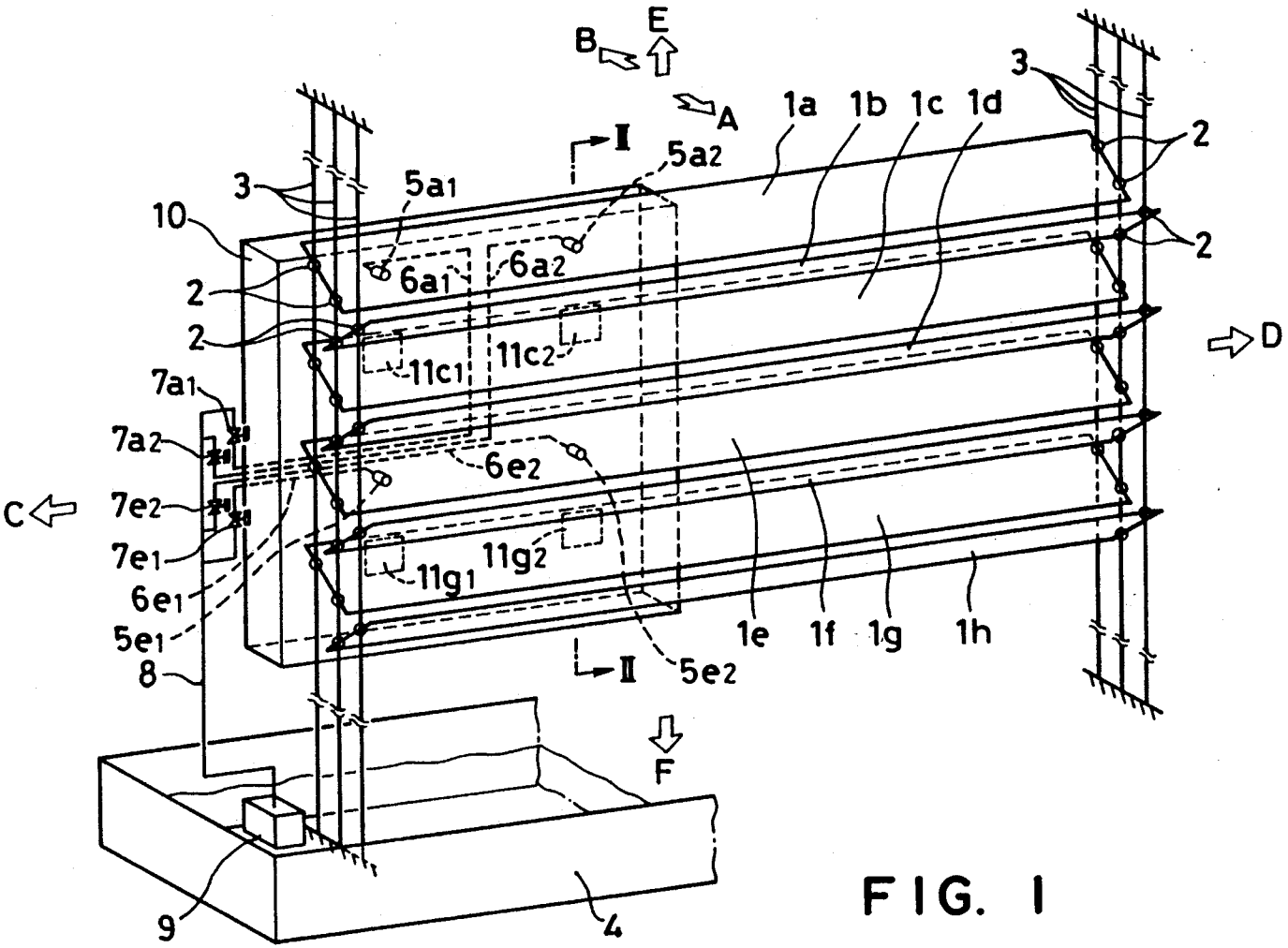
FIG. 1 is a perspective view showing a wall fountain module in accordance with a preferred embodiment of the present invention.

A wall fountain apparatus in accordance with the preferred embodiment of the present invention is described with reference to FIGS. 1 to 4. In the following descriptions, the directions indicated by arrows A, B, C, D, E, F, in FIG. 1 are referred to as the forward direction, rearward direction, leftward direction, rightward direction, upward direction and downward direction, respectively. Moreover, in the following descriptions, the direction parallel to the arrows C, D is referred to as the transverse direction, and the direction parallel to the arrows E, F is referred to as the vertical direction, respectively.

Figure 2:
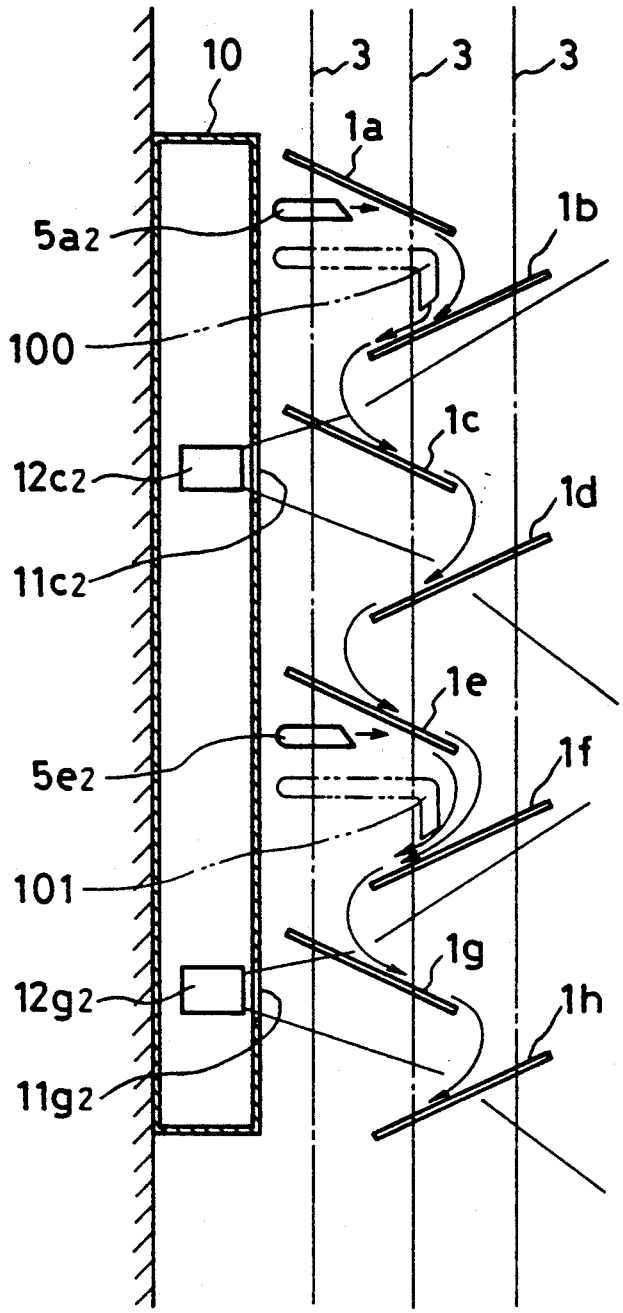
FIG. 2 is a sectional view along the line II—II in FIG. 1.

FIGS. 1, 2 shows a wall fountain module in accordance with a preferred embodiment of the present invention. As shown in FIGS. 1, 2, eight sheets of transparent glass 1*a*, 1*b*, 1*c*, 1*d*, 1*e*, 1*f*, 1*g*, and 1*h* are disposed in a zigzag in the vertical direction. The glass sheet 1*a* is located uppermost, while the glass sheet 1*h* is located lowermost. The glass sheets 1*a*, 1*c*, 1*e* and 1*g* are disposed horizontally in the transverse direction and inclined downward in the forward direction. The glass sheets 1*b*, 1*d*, 1*f* are 1*h* are disposed horizontally in the transverse direction and inclined downward in the rearward direction. The glass sheets 1*a*~1*h* are supported by wires 3 through fixtures 2 at both transverse ends thereof. The upper ends of the wires 3 are fixed to the ceiling of an indoor space, while the lower ends of the wires 3 are fixed to the bottom wall of a water tank 4 which is put on the floor of the indoor space. The glass sheets 1*a*~1*h*, the fixtures 2 and the wires 3 together define a glass sheet assembly module.

A nozzle $5a_1$ is disposed in the rear of the left end portion of the left half of the glass sheet 1*a*. A nozzle $5a_2$ is disposed in the rear of the right end portion of the left half of the glass sheet 1*a*. The nozzles $5a_1$ and $5a_2$ are disposed horizontally with their discharge openings being directed forward. In the same manner, a nozzle $5e_1$ is disposed in the rear of the left end portion of the left half of the glass sheet 1*e*, and a nozzle $5e_2$ is disposed in the rear of the right end portion of the left half of the glass sheet 1*e*. The nozzles $5a_1$, $5a_2$, $5e_1$ and $5e_2$ are communicated with a conduit 8 through conduits $6a_1$, $6a_2$, $6e_1$ and $6e_2$, and solenoid operated valves $7a_1$, $7a_2$, $7e_1$ and $7e_2$ respectively. The conduit 8 is communicated with a pump 9 which is put on the bottom wall of the water tank 4. The nozzles $5a_1$~$5e_2$, the conduits $6a_1$~$6e_2$, the solenoid operated valves $7a_1$~$7e_2$, the conduit 8 and the pump 9 together define a water supply module. An identical water supply module is disposed adjacent to and on the right of the aforementioned water supply module.

A lighting box 10 is disposed in the rear of the left half of the glass sheets 1*a*~1*h* and in the rear of the nozzles $5a_1$~$5e_2$. The lighting box 10 may be fixed to a side wall of the indoor space. The lighting box 10 is provided with lighting windows $11c_1$, $11c_2$, $11g_1$, $11g_2$ on the front wall thereof. The lighting window $11c_1$ is disposed to the rear of the left end portion of the left half of the glass sheet 1*c*, while the lighting window $11c_2$ is disposed to the rear of the right end portion of the left half of the glass sheet 1c. In the same manner, the lighting window 11g$_1$ is disposed to the rear of the left end portion of the left half of the glass sheet 1g, while the lighting window 11g$_2$ is disposed to the rear of the right end portion of the left half of the glass sheet 1g. The lighting windows are covered with transparent sheets, such as glass sheets. In the lighting box 10, color changeable electric lamps 12c$_1$, 12c$_2$, 12g$_1$ and 12g$_2$ are disposed to the rear of the lighting windows 11c$_1$, 11c$_2$, 11g$_1$ and 11g$_2$ respectively. The electric lamps 12c$_1$ and 12g$_1$ are not shown in FIGS. 1 and 2 for the sake of simplification of the drawings. The lamps 12c$_1$~12g$_2$, the lighting box 10 and the lighting windows 11c$_1$~11g$_2$ together define a lighting module. An identical lighting module is disposed adjacent to and on the right of the aforementioned lighting module.

Figure 3:
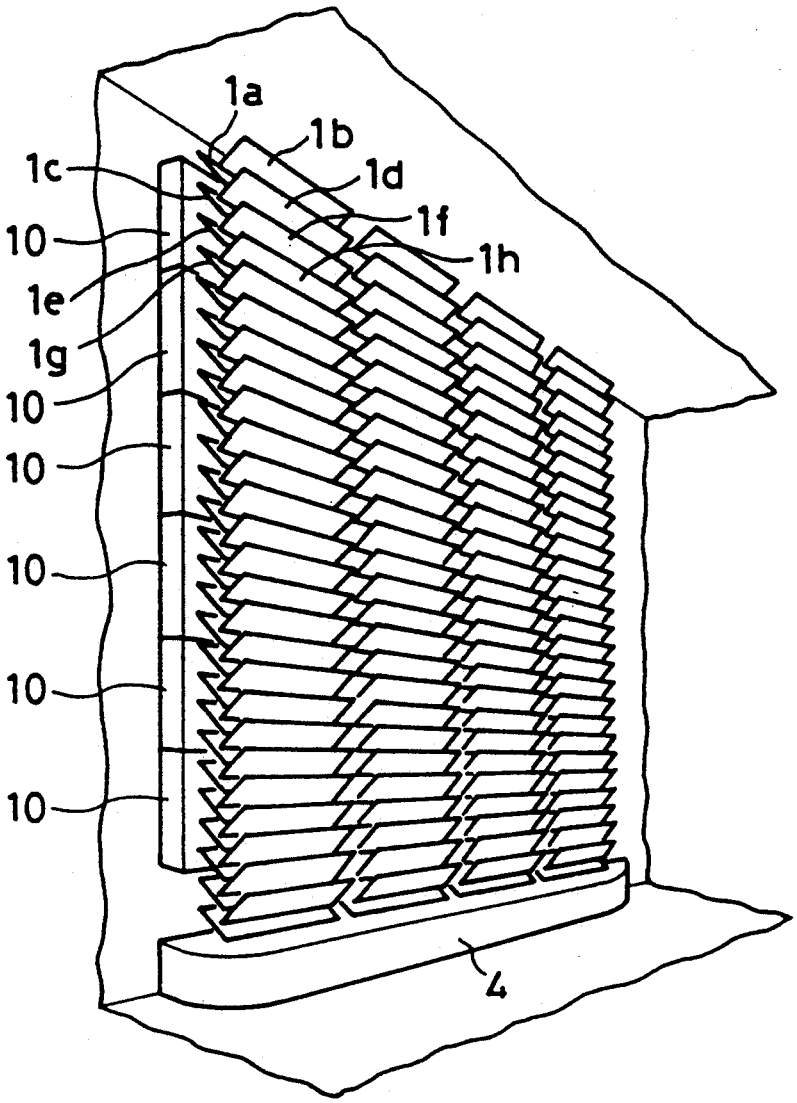
FIG. 3 is a perspective view showing a general arrangement of a wall fountain apparatus in accordance with the preferred embodiment of the present invention.

The glass sheet assembly module, the two adjacent water supply modules and the two adjacent lighting modules together define a wall fountain module. A plurality of the wall fountain modules, which are disposed adjacent to one another in the vertical direction and in the transverse direction, define a wall fountain apparatus as shown in FIG. 3.

Figure 4:
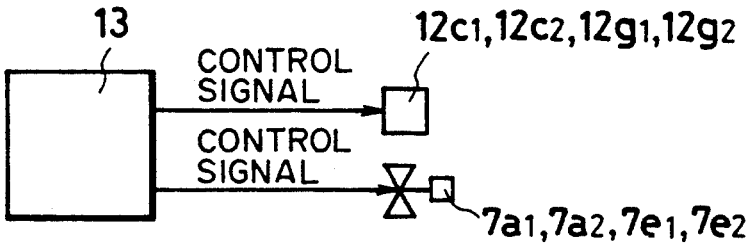
FIG. 4 is a schematic view of a control unit in accordance with the preferred embodiment of the present invention.

The water supply modules and the lighting modules are controlled by a control unit 13 as shown schematically in FIG. 4.

The operation of the above constructed wall fountain apparatus is described with reference to the module shown in FIGS. 1, 2 and 4.

Under the control of the control unit 13, the water supply modules operate individually. The water, which is drawn up from the water tank 4 by the pump 9 and the flow rate of which is controlled by the solenoid operated valves 7a$_1$~7e$_2$, is supplied to the glass sheet assembly module through the nozzles 5a$_1$~5e$_2$. The water currents discharged forward from the nozzles 5a$_1$~5e$_2$ collide with the under surfaces of the glass sheets 1a, 1e which are inclined downward in the forward direction so that the water currents flow downward in the forward direction along the under surfaces of the glass sheets 1a, 1e. Thereafter, the water currents fall down from the fore edges of the glass sheets 1a, 1e onto the upper surfaces of the glass sheets 1b, 1f which are inclined downward in the rearward direction so that the water currents flow downward in the rearward direction along the upper surfaces of the glass sheets 1b, 1f. Then, the water currents fall down from the rear edges of the glass sheets 1b, 1f onto the upper surfaces of the glass sheets 1c, 1g which are inclined downward in the forward direction so that the water currents flow downward in the forward direction along the upper surfaces of the glass sheets 1c, 1g. The water currents thus flow down in zigzag paths continuously along the upper surfaces of the glass sheets 1b~1h and 1f~1h. Thus, the flow velocities of the water currents of the present wall fountain are low by far compared with those of the conventional wall fountains so that the sound of the water currents of the present wall fountain is much softer compared with the sound of conventional wall fountains. Therefore the present wall fountain apparatus is suited to be installed indoors.

Under the control of the control unit 13 shown in FIG. 3, the lighting modules operate individually and lights from the electric lamps 12c$_1$~12g$_2$ are projected out forward through the lighting windows 11c$_1$~11g$_2$. The lights which are projected out forward pass through the water currents which flow down along the glass sheet assembly module. When the lights pass through the water currents, they diffuse because of the reflection of entrained air bubbles, the diffraction effect of the zigzag water currents, etc. Thus, the region of a water screen formed by the water currents in front of the lighting box 10 or the lighting module is uniformly illuminated as an illuminant module. That is, the distances between the electric lamps 12c$_1$~12g$_2$ and the water currents, the distances between the electric lamps 12c$_1$~12g$_2$, etc., are determined so that the region of the water screen formed by the water currents in front of the lighting box 10 or the lighting module may be uniformly illuminated as an illuminant module. Thus, in accordance with the present wall fountain apparatus, various kinds of light patterns with various kinds of colors can be projected on the water screen by controlling the lighting modules individually. Moreover, in accordance with the present wall fountain apparatus, the number of the air bubbles entrained in the water currents or the transparency of the water screen can be controlled anywhere in the water screen by controlling the water supply modules individually. As a result, in accordance with the present wall fountain apparatus, various kinds of light patterns with various kinds of colors and textures can be projected on the water screen.

It may be possible to substitute transparent plastic sheets, or any other appropriate transparent sheets for the transparent glass sheets 1a~1h. The pump 9 may supply a plurality of water supply modules with water. The discharge openings of the nozzles 5a$_1$~5e$_2$ may be directed downward as shown by phantom nozzles 100 and 101 in FIG. 2 so that the water currents discharged from the nozzles 5a$_1$~5e$_2$ may collide with the upper surfaces of the glass sheets 1b, 1f.

One may substitute electric operated valves for the solenoid operated valves 7a$_1$~7e$_2$. One may also increase or decrease the number of the nozzles, and color changeable electric lamps.

While the present invention has been described with reference to preferred embodiments, one of ordinary skill in the art will recognize that modifications and improvements may be made while remaining within the spirit and scope of the present invention. The scope of the invention is determined solely by the appended claims.

I claim:

1. A wall fountain apparatus, comprising:

transparent sheets disposed in zigzags in a vertical direction to form zigzag paths for guiding water currents;

means for supporting the transparent sheets; and a plurality of nozzles for supplying the transparent sheets with water, each nozzle being directed to an underside of a transparent sheet.

2. A wall fountain apparatus according to claim 1, further comprising lighting means for illuminating a water screen formed by said water currents.

3. A wall fountain apparatus according to claim 2, further comprising means for controlling the flow rate of the water supplied through said nozzles and means for controlling the lighting means.

4. A wall fountain apparatus, comprising a plurality of wall fountain modules disposed adjacent to one another, and controlling means for controlling the wall fountain modules, wherein each of the wall fountain modules comprises:

transparent sheets disposed in zigzags in a vertical direction to form zigzag paths for guiding water currents;

supporting means for supporting the transparent sheets;

a plurality of nozzles for supplying the transparent sheets with water, each nozzle being directed to an underside of a transparent sheet; and lighting means for illuminating a water screen formed by the water currents; wherein the controlling means controls the flow rate of the water supplied through said nozzles, and controls the lighting means.

5. A water fountain apparatus according to claim 4, wherein said wall fountain modules are adjacent in the vertical and transverse directions.

6. A wall fountain apparatus, comprising:

transparent sheets disposed in zigzags in the vertical direction, wherein adjacent transparent sheets are inclined in opposite directions to form zigzag paths for guiding water currents;

supporting means for supporting the transparent sheets; and water supply means for supplying the transparent sheets with water.

7. A wall fountain apparatus according to claim 6, wherein said water supply means comprises a plurality of nozzles directed to the transparent sheets.

8. A wall fountain apparatus according to claim 7, wherein each of said plurality of nozzles is directed to an underside of a transparent sheet.

9. A wall fountain apparatus according to claim 7, wherein each nozzle is directed to an upper side of a transparent sheet.

10. A wall fountain apparatus according to claim 6, further comprising lighting means for illuminating a water screen formed by said water currents.

11. A wall fountain apparatus according to claim 10, further comprising controlling means for controlling the operation of said water supply means and said lighting means.

12. A wall fountain apparatus comprising a plurality of wall fountain modules disposed adjacent to one another, and controlling means for controlling the wall fountain modules, wherein each of the wall fountain modules comprises:

transparent sheets disposed in zigzags in the vertical direction, wherein adjacent transparent sheets are inclined in opposite directions to form zigzag paths for guiding water currents;

supporting means for supporting the transparent sheets;

water supply means for supplying the transparent sheets with water; and lighting means for illuminating a water screen formed by the water currents; wherein the controlling means controls the water supply means and the lighting means independently.

13. A wall fountain apparatus according to claim 12, wherein said water supply means comprises nozzles directed toward the transparent sheets.

14. A water fountain apparatus according to claim 12, wherein said wall fountain modules are adjacent in the vertical and transverse directions.

* * * * *